US005107808A

United States Patent [19]

Mahn et al.

[11] Patent Number: 5,107,808

[45] Date of Patent: Apr. 28, 1992

[54] RESERVOIR ASSEMBLY HAVING A DRAIN THEREIN

[75] Inventors: Michael A. Mahn, Princeville; Timothy A. Vik, Sparland, both of Ill.

[73] Assignee: Caterpillar Inc., Peoria, Ill.

[21] Appl. No.: 684,752

[22] Filed: Apr. 15, 1991

[51] Int. Cl.[5] ..... F16N 33/00

[52] U.S. Cl. ..... 123/195 C; 123/196 R; 184/1.5; 220/465

[58] Field of Search ..... 123/195 C, 196 R; 184/1.5; 220/465, 571

[56] References Cited

U.S. PATENT DOCUMENTS

| | | | |
|---|---|---|---|
| 3,097,663 | 7/1963 | Buchwald | 137/351 |
| 3,148,901 | 9/1964 | Campbell | 285/212 |
| 3,387,621 | 6/1968 | Schaff | 184/1.5 |
| 3,727,638 | 4/1973 | Zaremba, Jr. et al. | 184/1.5 |
| 3,754,677 | 8/1973 | Hug | 220/39 R |
| 3,933,358 | 1/1976 | Hoer | 277/170 |
| 4,119,178 | 10/1978 | Hass | 184/1.5 |
| 4,745,894 | 5/1988 | Laipply et al. | 123/196 R |
| 4,930,469 | 6/1990 | Kamprath et al. | 123/195 C |
| 4,938,314 | 7/1990 | Sitzler et al. | 123/195 C |
| 5,046,634 | 9/1991 | McFarlin et al. | 220/465 |

FOREIGN PATENT DOCUMENTS

| | | | |
|---|---|---|---|
| 2578908 | 9/1986 | France | 184/1.5 |
| 206961 | 10/1985 | Japan | 123/195 C |
| 71510 | 3/1988 | Japan | 184/1.5 |

*Primary Examiner*—E. Rollins Cross
*Assistant Examiner*—Weilun Lo
*Attorney, Agent, or Firm*—Larry G. Cain

[57] ABSTRACT

The design and construction of present oil pan assemblies have caused increased manufacturing cost, reduced seal life and reduced engine reliability. The present invention overcomes these oil pan assembly construction problems by using an oil pan assembly including a thin walled structure having a drain port formed therein. The thin walled structure further has a frusto-conical contoured lip around the drain port being concave toward the inside surface. The frusto-conical contoured lip has a sealing surface on the portion of the outside surface forming the frusto-conical contoured lip. A reinforcing member having a threaded hole therein and a conically contoured support surface at one end of the threaded hole is positioned so that the threaded hole is generally centered about the drain port. The support surface is located in supporting relationship to the frusto-conical lip. A drain plug having a threaded end and a sealing surface also includes an O-ring seal removably attached to the drain plug. Thus, when the components are in functionally working relationship, the O-ring engages with the sealing surface of the drain plug and the sealing surface of the frusto-conical contoured lip.

18 Claims, 3 Drawing Sheets

RESERVOIR ASSEMBLY HAVING A DRAIN THEREIN

TECHNICAL FIELD

This invention relates generally to an internal combustion engine and more particularly to an oil pan and drain plug assembly.

BACKGROUND ART

The oil pans used with many internal combustion engines are generally made of a thin walled material. The sump portion of such a thin wall oil pan usually has a drain opening therein. Since walls of the pan are thin, a reinforcing member is usually attached around the drain opening and has a threaded hole therein. A plug having a seal or gasket thereon is screwed into the reinforcing member and the gasket seals against the thin wall of the pan. An example of such a drain mechanism is disclosed in U.S. Pat. No. 3,754,677 issued to Karl Hug on Aug. 28, 1973. For example, a threaded plug having a flat seal thereon is screwed into a threaded nut. As the plug is tighten in the nut the flat seal is brought into sealing contact with the thin wall of the container or pan and seals. The drain plug and seal combinations of this configuration have several major drawbacks: if the plug is over tightened the threads may be stripped, or the gasket may be damaged and failure of the seal can occur, and if the plug is undertightened the joint can leak.

Another example of a drain plug assembly is disclosed in U.S. Pat. No. 3,079,663 issued to Robert M. Buchwald on Jul. 16, 1963. This patent discloses a thin walled oil pan having a drain plug located within the sump portion of the oil pan. The configuration includes a flared port in the pan and a drain plug assembly. The drain plug assembly is constructed of a perforated support member secured to the inside of the sump portion and positioned concentric to the drain port. The support member has a valve or drain plug member threadedly mounted therein. The drain plug has an O-ring seal retained therein. As the drain plug is unscrewed from the support member, the O-ring comes into contact with the flared portion of the flared port and seals thereon. In this configuration, if an excess torque is applied to the drain plug the area around the flared port can bend. The results of the bent or deflected surface can result in the seal not seating and leakage can occur. Another disadvantage of this configuration is that if an excess torque is applied to the drain plug, the support member is forced or pushed away from the pan to which it is mounted, thus, highly stressing the connection therebetween. The continued flexing of the joint can cause failure of the joint or the metal therearound resulting in leakage. Another drawback to the internally positioned drain plug occurs as the O-ring is unseated. The hot oil escapes as soon as the O-ring is unseated and continues to spill onto the individual's hand or tool as the drain passage is continued to be opened. Thus, the added aggravation and unnecessary cleanup compounds the undesirable use of the above described drain plug configuration. A further drawback exists when the O-ring seal becomes damaged and a replacement seal is needed. The ability to replace the above seal is nearly impossible.

The present invention is directed to overcoming one or more of the problems as set forth above.

DISCLOSURE OF THE INVENTION

In one aspect of the present invention, an engine including a block and has an oil pan assembly attached thereto. The oil pan assembly includes a thin walled structure having an inside surface facing toward the block and an outside surface facing away from the inside surface. A drain port communicates between the inside surface and the outside surface. The thin walled structure further has a frusto-conical contoured lip around the drain port being concave toward the inside surface. The oil pan assembly further includes a reinforcing member which has a first surface attached to the inside surface of the thin walled structure. The reinforcing member has a threaded hole therein generally centered about the drain port. The reinforcing member further has a conically contoured surface interposed between the first surface and the threaded hole. The conically contoured surface is nested around the frusto-conical contoured lip. The oil pan assembly further includes a drain plug which has a threaded end and a gripping end. The drain plug further has an annular recess intermediate the gripping end and the threaded end. The annular recess has a sealing surface as a part thereof. The oil pan assembly further includes a sealing means removably attached to the drain plug and positioned in the annular recess. The sealing means sealingly engages the sealing surface of the drain plug and the sealing surface of the frusto-conical contoured lip around the drain port at the portion of the outside surface forming the frusto-conical contoured lip when positioned in sealing working relationship.

In another aspect of the invention, a drain port assembly for use with a reservoir includes a reservoir including a thin walled structure having an inside surface, an outside surface, and a drain port communicating between the inside surface and the outside surface. The thin walled structure further has a frusto-conical contoured lip around the drain port being concave toward the inside surface. The frusto-conical contoured lip has a sealing surface thereon the portion of the outside surface forming the frusto-conical contoured lip. The drain port assembly further includes a reinforcing member having a first surface attached to the inside surface of the thin walled structure. The reinforcing member has a threaded hole therein generally centered about the drain port. The reinforcing member further has a conically contoured surface interposed between the first surface and the threaded hole. The conically contoured surface is nested around the frusto-conical contoured lip. The drain port assembly further includes a drain plug having a threaded end and a gripping end. The drain plug further has an annular recess intermediate the gripping end and the threaded end. The recess has a sealing surface as a part thereof. The drain port assembly further includes a sealing means removably attached to the drain plug and positioned in the annular recess. The sealing means sealingly engages the sealing surface of the drain plug and the sealing surface of the frusto-conical contoured lip around the drain port at the portion of the outside surface forming the frusto-conical contoured lip when positioned in sealing working relationship.

BEST MODE FOR CARRYING OUT THE INVENTION

Figure 1:
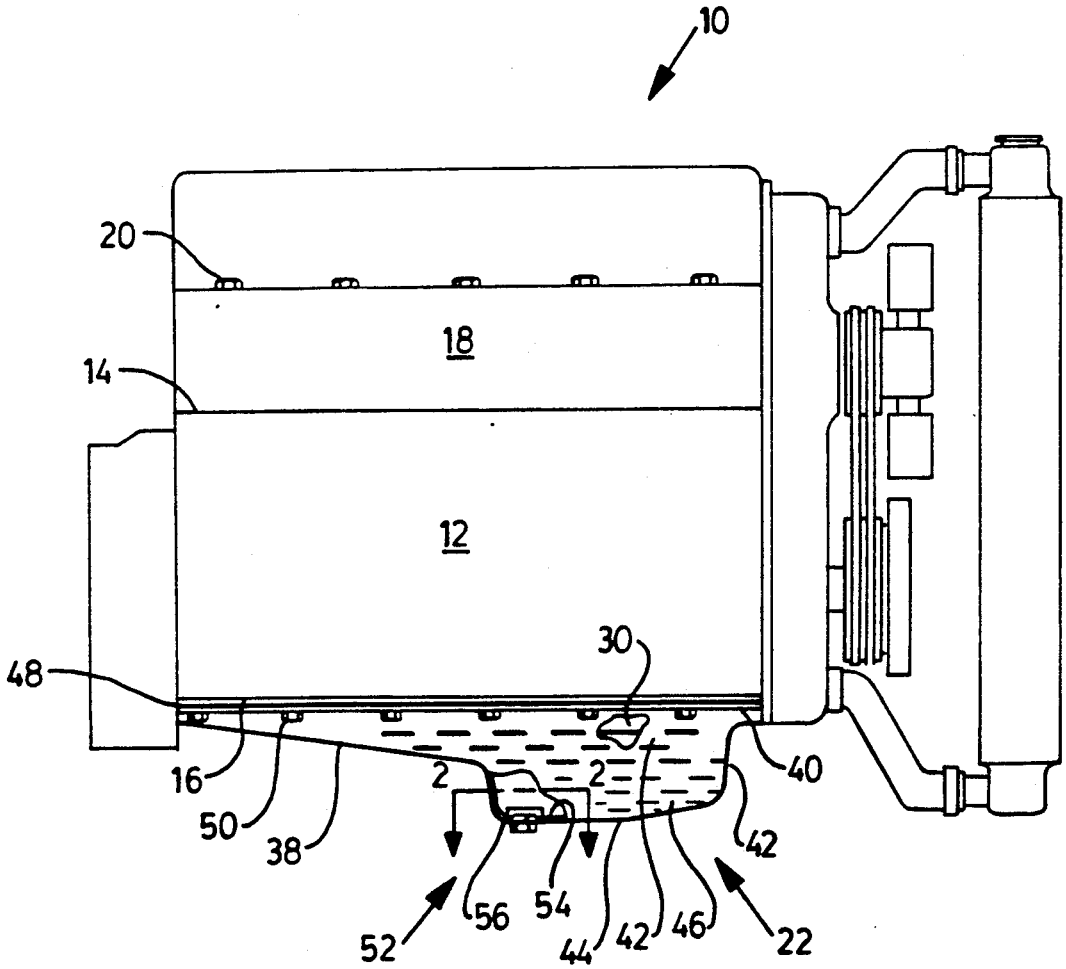
FIG. 1 is a side view of an engine having an embodiment of the present invention.
Figure 2:
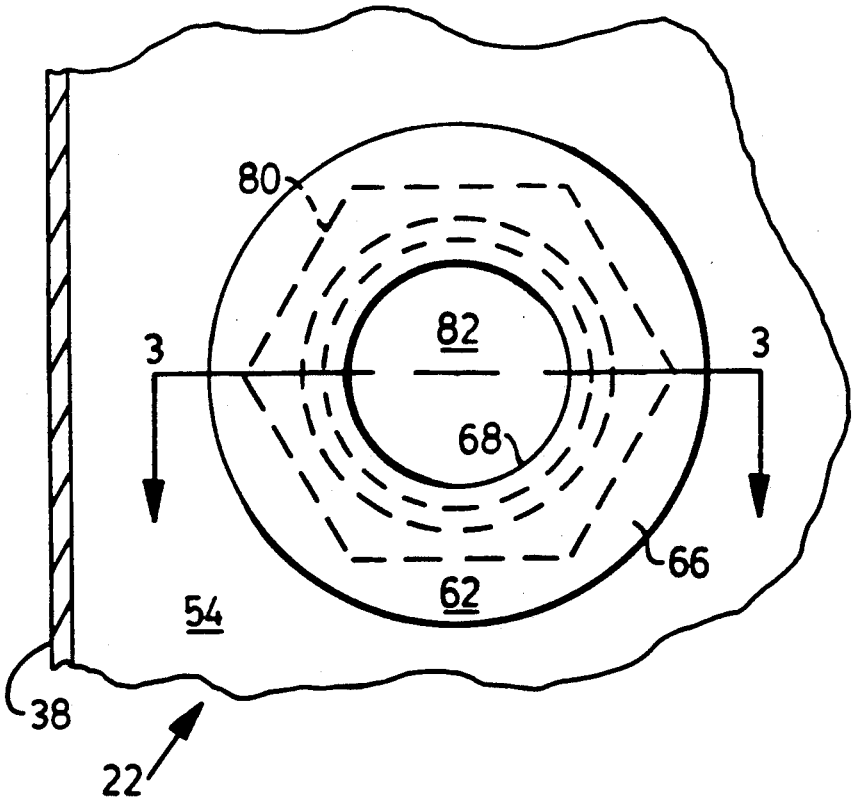
FIG. 2 is an enlarged broken out view of a portion of an oil pan taken along line 2—2 of FIG. 1 having an embodiment of the present invention.
Figure 3:
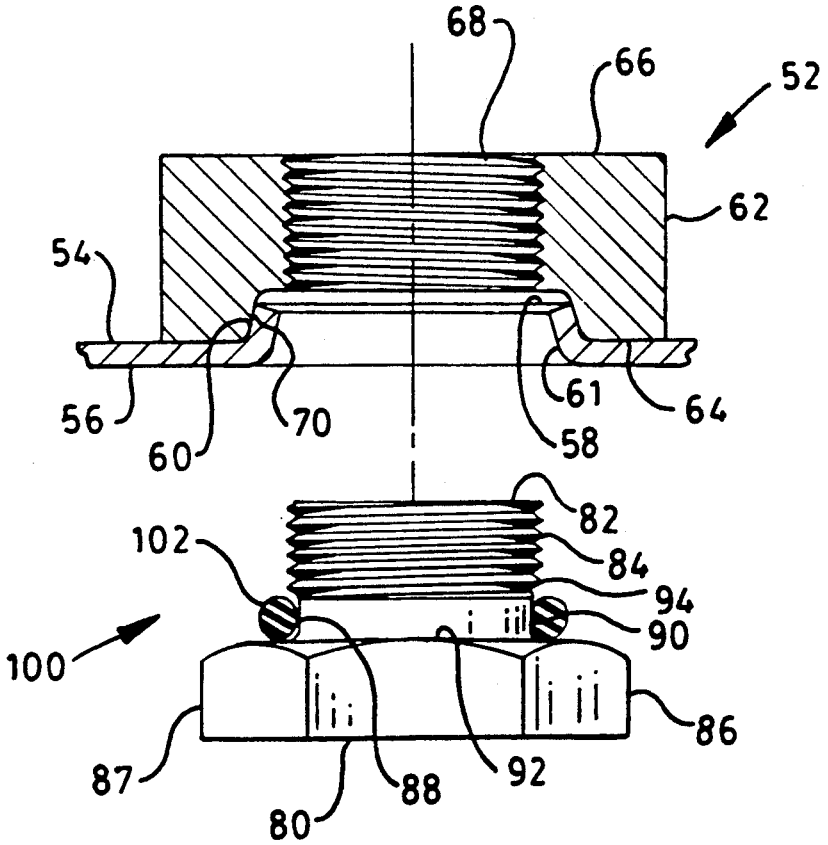
FIG. 3 is an exploded partially sectioned view taken along line 3—3 of FIG. 2.

Referring to the drawings, more specifically FIG. 1, an engine 10 includes a block 12 having a top mounting surface 14 and a bottom mounting surface 16. A plurality of threaded holes, not shown, are positioned in the bottom mounting surface 16 and have a preestablished pattern thereto. In addition, the engine 10 includes a cylinder head 18 attached to the top mounting surface 14 of block 12 in a conventional manner such as by a plurality of bolts 20. The engine 10 further includes an oil pan or reservoir assembly 22 removably, sealingly attached to the bottom mounting surface 16 of the block 12 in a conventional manner. The engine 10 further includes a conventional lubricating system, not shown, in which a lubricating fluid, designated by number 30, is used to cool and lubricate the working components of the engine 10.

The oil pan or reservoir assembly 22 includes a thin walled stamped structure 38 having a mounting flange 40 and a plurality of side members 42 extending from the mounting flange 40. In this application, the oil pan has a wall thickness of about 1.5 mm. A bottom plate 44 is attached to the plurality of side member 42 forming a sump portion 46. The mounting flange 40 includes a plurality of mounting holes therein, not shown, which correspond to the plurality of threaded holes in the bottom mounting surface 16 of the block 12. A gasket 48 has a plurality of mounting holes therein, not shown, corresponding to the plurality of threaded holes in the block 12. The gasket 48 is positioned between the bottom mounting surface 16 of the block 12 and the stamped structure 38. A plurality of mounting bolts 50 removably attach the block 12, gasket 48, and the oil pan assembly 22 together in sealing relationship.

A drain port assembly 52 is fixedly attached to the sump portion 46 of the stamped structure 38. The bottom plate 44 of the stamped structure 38 includes an inside surface 54 facing toward the block 12, an outside surface 56 facing away from the block 12, and a drain port 58 communicating between the inside surface 54 and the outside surface 56. The drain port 58 has a frusto-conical contoured lip 60 therearound. The frusto-conical lip 60 is concave toward the inside surface 54. A portion of the outside surface 56 forming the frusto-conical lip 60 has a sealing surface 61 thereon. A reinforcing member 62 has a first surface 64 attached to the inside surface 54 of the stamped structure 38 such as by welding. The weld used to attach the reinforcing member 62 to the stamped structure 38 does not require a seal or fluid tight connection therebetween. The reinforcing member 62 further has a second surface 66 spaced from the first surface 64 a predetermined distance providing the reinforcing member 62 with a thickness being greater than the thin walled stamped structure 38. A threaded hole 68 is provided in the reinforcing member 62 and extends generally between the first and second surfaces 64,66. In this application the thickness of the reinforcing member 62 is about 12.5 mm and the diameter of the threaded hole is about 12.5 mm. In applications where a larger threaded hole 68 is desirable the thickness of the reinforcing member 62 will be increased to insure proper thread engagement between mating components. The reinforcing member 62 further has a supporting surface 70 which in this application has a conical contour extending toward the second surface 66 from the first surface 64 into the threaded hole 68. When assembled in working relationship, the threaded hole 68 is generally centered about the drain port 58, the frusto-conical lip 60 of the drain port 58 is nested around the support or conically contoured surface 70 of the reinforcing member 62 and the first surface 64 on the reinforcing member 62 is in contact with the inside surface 54 of the stamped structure 38.

A drain plug 80 is further included in the drain port assembly 52. The drain plug 80 is of a conventional design and has a cylindrical core 82 having a threaded end 84. A gripping end 86 is attached to the core 82 at the end opposite the threaded end 84 and extends radially from the core 82. The gripping end 86 has a hexagonal external configuration forming a head 87. An annular recess 88 is defined in the core and is positioned intermediate the gripping portion 86 and the threaded end 84 of the drain plug 80. The annular recess 88 includes a bottom portion 90 radially inward of the threads on the threaded end 84, a sealing surface 92 extends radially outward from the bottom portion 90, encircles the core 82 and generally extends radially toward the extremity of the gripping portion 86. A tapered portion 94 further completes the geometry of the annular recess 88. The tapered portion 94 extends from the bottom portion 90 toward the threaded end 84 and intersects with the threads.

A sealing means 100 is further included in the drain port assembly 52. The sealing means 100 is removably attached to the drain plug 80 and is positioned in the annular recess 88. In this application, the sealing means includes a non-porous, elastomeric, toroidal ring 102 constructed of an oil resistant material such as neoprene. The ring 102 has a generally circular cross-sectional configuration such as an O-ring. The O-ring, when in functional working relationship, engages with the sealing surface 92 of the drain plug 80 and the sealing surface 61 of the frusto-conical contoured lip 60 around the drain port 58.

INDUSTRIAL APPLICABILITY

In operation, the engine 10 is adapted to have a thin walled oil pan assembly 22 attached thereto. The oil pan assembly 22 is formed or made to have the drain port assembly 52 located within the sump portion 46. For example, the oil pan structure 38 of the oil pan assembly 22 is die formed. The forming operation contours the mounting flange 40, the plurality of side members 42 and the bottom plate 44. The plurality of mounting holes in the flange 40 and the drain port 58 are stamped therein during the forming operation. After the initial forming operation, a second forming operation is preformed to construct the frusto-conical contoured lip 60 around the drain port 58. The next operation is to assemble the reinforcing member 62 with the threaded hole 68 generally centered about the drain port 58 and with the frusto-conical lip 60 nested around the conically contoured surface 70. After positioning the components, the reinforcing member 62 is welded to the bottom plate by a spot welding process. To complete the oil pan 22 assembly, the drain plug 80 and the O-ring 102 are added thereto.

Thus, after actual construction of the oil pan assembly 22 has been completed, the oil pan 22 is assembled to the bottom mounting surface 16 of the engine block 12. For sealing purposes, the gasket 48 is positioned between the bottom mounting surface 16 and the mounting flange 40 and the plurality of mounting bolts 50 are threadedly attached to the block 12. Lubricating oil 30 is added to the engine 10 and is generally stored in the sump portion 46 of the oil pan 22. As the engine 10 is operated, the lubricating system draws oil 30 from the sump portion 46 and circulated the oil 30 through the engine 10 for lubricating and cooling purposes. As the engine 10 operates, the oil 30 becomes contaminated with dirt, metal particles, acids, and other contaminates. After a preestablished period of operating time, the contaminated oil 30 is drained from the engine 10 and new oil 30 is added.

From the foregoing, it will be apparent that an oil pan or reservoir assembly 22 made according to the invention ensures an improved structural combination, sealing device and serviceable unit. The structural relationship of the assembled components ensures the integrity of the oil pan or reservoir assembly 22 being sealed. For example, the reinforcing member 62 is positioned so that the frusto-conical contoured lip 60 is nested around the conically contoured surface 70 of the reinforcing member 62 and is welded to the inside surface 54 of the bottom plate 44. The ring 102 is positioned in the annular recess 88 on the drain plug 80 and when the threaded end 84 is tightened in the threaded hole 68 and the ring 102 comes into low frictional contact with the sealing surface 61 on the frusto-conical contoured lip 60 and the sealing surface 92 on the drain plug 80 the combination insures that the components are sealing attached. The structure as described above results in a highly reliable structural combination wherein the thin walled structure 38 and the reinforcing member 62 are placed in a compressive state of assembly. Unlike the high load requirement combination of the drain plug and the static flat seal, the sealing joint between the O-ring 102, the sealing surface 92, and the sealing surface 61 on the frusto-conical contoured lip 60 around the drain port 58 provides a low friction, low torque sealing joint. The results of the low torque sealing joint further reduces the possibility of the threaded hole 68 within the reinforcing member 62 or the threaded end 84 of the drain plug 80 being stripped and failing. The use of a generally circular cross-sectional seal, the O-ring 102, verses a flat seal reduces the surface area on which dirt and other contaminated can adhere. The reduction of the contaminates on the sealing surface reduces the possibility of the contaminates from cutting or embedding into the seal resulting in increased life of the seal. The low friction sealing requirement between the components further increases the life of the O-ring 102 or sealing member since the tendency for the contaminates to become embedded into the seal is less.

Other aspects, objects and advantages of this invention can be obtained from a study of the drawings, the disclosure and the appended claims.

We claim:

1. An engine including a block having an oil pan assembly attached thereto, comprising:

said oil pan assembly including a thin walled structure having an inside surface facing toward the block, an outside surface facing away from the inside surface and a drain port communicating between the inside surface and the outside surface, said thin walled structure further having a frusto-conical contoured lip around the drain port being concave toward the inside surface, and said frusto-conical contoured lip having a sealing surface on the portion of the outside surface forming the frusto-conical contoured lip;

a reinforcing member having a first surface being attached to the inside surface of the thin walled structure, said reinforcing member having a threaded hole therein, said threaded hole being generally centered about the drain port; said reinforcing member further having a conically contoured supporting surface interposed between the first surface and the threaded hole, said supporting surface being located in supporting relationship to the frusto-conical contoured lip;

a drain plug having a threaded end and a gripping end, said drain plug further having an annular recess intermediate the gripping end and the threaded end, said annular recess having a sealing surface as a part thereof; and sealing means removably attached to the drain plug and being positioned in the annular recess, said sealing means sealingly engaging the sealing surface of the drain plug and the sealing surface of the frusto-conical contoured lip around the drain port when positioned in sealing working relationship.

2. The engine of claim 1 wherein said conically contoured supporting surface is nested around the frusto-conical contoured lip.

3. The engine of claim 1 wherein said reinforcing member is welded to the bottom plate.

4. The engine of claim 1 wherein said gripping end has a hexagonal external configuration.

5. The engine of claim 1 wherein said sealing means includes a non-porous, elastomeric, toroidal ring.

6. The engine of claim 5 wherein said ring has a generally circular cross-sectional configuration.

7. The engine of claim 6 wherein said ring is made of an oil resistant material.

8. The engine of claim 7 wherein said ring is made of a neoprene material.

9. The engine of claim 1 wherein said drain plug when operationally installed in its sealing position places the thin walled structure and the reinforcing member in a compressive state of assembly.

10. A reservoir assembly, comprising:

said reservoir assembly including a thin walled structure having an inside surface, an outside surface and a drain port communicating between the inside surface and the outside surface, said thin walled structure further having a frusto-conical contoured lip around the drain port being concave toward the inside surface, and said frusto-conical contoured lip having a sealing surface on the portion of the outside surface forming the frusto-conical contoured lip;

a reinforcing member having a first surface being attached to the inside surface of the thin walled structure, said reinforcing member having a threaded hole therein, said threaded hole being generally centered about the drain port; said reinforcing member further having a conically contoured support surface interposed between the first surface and the threaded hole, said support surface being located in supporting relationship to the frusto-conical contoured lip;

a drain plug having a threaded end and a gripping end, said drain plug further having an annular recess intermediate the gripping end and the threaded end, said annular recess having a sealing surface as a part thereof; and sealing means removably attached to the drain plug and being positioned in the annular recess, said sealing means sealingly engaging the sealing surface of the drain plug and the sealing surface of the frusto-conical contoured lip around the drain port at the portion of the outside surface forming the frusto-conical contoured lip when position in sealing working relationship.

11. The reservoir assembly of claim 10 wherein said conically contoured supporting surface is nested around the frusto-conical contoured lip.

12. The reservoir assembly of claim 10 wherein said reinforcing member is welded to the bottom plate.

13. The reservoir assembly of claim 10 wherein said gripping end has a hexagonal external configuration.

14. The reservoir assembly of claim 10 wherein said sealing means includes a non-porous, elastomeric, toroidal ring.

15. The reservoir assembly of claim 14 wherein said ring has a generally circular cross-sectional configuration.

16. The reservoir assembly of claim 15 wherein said ring is made of an oil resistant material.

17. The reservoir assembly of claim 16 wherein said ring is made of a neoprene material.

18. The drain port assembly of claim 10 wherein said drain plug when operationally installed in its sealing position places the thin walled structure and the reinforcing member in a compressive state of assembly.

* * * * *